US007051960B2

(12) United States Patent
Oguma

(10) Patent No.: US 7,051,960 B2
(45) Date of Patent: May 30, 2006

(54) FUEL INJECTION VALVE

(75) Inventor: Yoshitomo Oguma, Hekinan (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/149,542

(22) Filed: Jun. 10, 2005

(65) Prior Publication Data

US 2006/0006255 A1 Jan. 12, 2006

(30) Foreign Application Priority Data

Jul. 8, 2004 (JP) ..... 2004-201589

(51) Int. Cl.
*B05B 1/30* (2006.01)

(52) U.S. Cl. ..... 239/585.1; 239/585.3; 239/585.4; 239/585.5; 239/900; 251/129.16; 251/129.19

(58) Field of Classification Search ..... 239/585.1, 239/585.3, 585.4, 585.5, 900, 533.2; 251/129.15, 251/129.66, 129.19; 123/490, 491
See application file for complete search history.

(56) References Cited

U.S. PATENT DOCUMENTS

| | | | | |
|---|---|---|---|---|
| 4,662,567 | A * | 5/1987 | Knapp | 239/585.4 |
| 5,732,888 | A | 3/1998 | Maier et al. | |
| 6,079,642 | A * | 6/2000 | Maier | 239/585.1 |
| 6,405,947 | B1 * | 6/2002 | Fochtman | 239/585.4 |
| 6,648,249 | B1 * | 11/2003 | Dallmeyer | 239/585.1 |

* cited by examiner

*Primary Examiner*—Dinh Q. Nguyen
(74) *Attorney, Agent, or Firm*—Nixon & Vanderhye PC

(57) ABSTRACT

A fuel passage is formed through a movable core and a fixed core of a fuel injection valve. Communication passage(s) are formed in the movable core or the fixed core around the fuel passage. The communication passage(s) connect a facing space provided between the movable core and the fixed core with a space remote from the facing space. Fuel flows out of the facing space through the communication passage(s) when the fuel injection valve is opened and fuel flows into the facing space through the communication passage(s) when the fuel injection valve is closed.

22 Claims, 6 Drawing Sheets

FUEL INJECTION VALVE

CROSS REFERENCE TO RELATED APPLICATION

This application is based on and incorporates herein by reference Japanese Patent Application No. 2004-201589 filed on Jul. 8, 2004.

BACKGROUND OF THE INVENTION

1. Field of the Invention

The present invention relates to a fuel injection valve.

2. Description of Related Art

A fuel injection valve supplies drive current to a coil to generate a magnetic attraction for attracting a movable core to a fixed core. Thus, a valve member lifts with the movable core, and the fuel injection valve injects fuel. In such a fuel injection valve, it is required to increase a range (dynamic range) of an energizing period, during which an injection quantity can be controlled with high accuracy. In order to increase the dynamic range, it is necessary to control the injection quantity with high accuracy specifically when the energizing period is short. Therefore, valve opening response and valve closing response should preferably be improved.

However, movement of the movable core in a valve opening direction will be hindered and the valve opening response will be deteriorated if a pressure in a facing space formed between the fixed core and the movable core increases when the coil is energized and the fixed core attracts the movable core.

Also, movement of the movable core in a valve closing direction will be hindered and the valve closing response will be deteriorated if the pressure in the facing space decreases when the coil is de-energized and the movable core separates from the fixed core.

Therefore, in a fuel injection valve disclosed in JP-A-H08-506876, a protrusion is provided on a surface of the fixed core or the movable core on a side on which the fixed core and the movable core face each other. Thus, a contact area on which the fixed core and the movable core contact is reduced. Accordingly, the hindrance of the pressure in the facing space to the movement of the movable core is inhibited when the valve is opened or closed. Thus, the valve opening response and the valve closing response can be improved.

However, the pressure in the facing space increases or decreases when the valve is closed or opened even if the contact area between the fixed core and the movable core is reduced. Therefore, the movement of the movable core is still hindered when the valve is opened or closed. As a result, the valve opening response and the valve closing response cannot be improved sufficiently.

SUMMARY OF THE INVENTION

It is therefore an object of the present invention to provide a fuel injection valve that improves valve opening response and valve closing response.

According to an aspect of the present invention, a communication passage is formed in at least one of a fixed core and a movable core of a fuel injection valve in addition to a fuel passage, which passes fuel to be injected through an injection hole. The communication passage connects a facing space formed between the fixed core and the movable core with another space. The fixed core and the movable core face each other through the facing space. The fuel in the facing space flows to the other space through the communication passage when the fixed core attracts the movable core to open the fuel injection valve. Therefore, a pressure increase in the facing space is alleviated when the fuel injection valve is opened. As a result, valve opening response is improved.

The fuel flows into the facing space from the other space through the communication passage when the movable core separates from the fixed core to close the fuel injection valve. Therefore, the pressure decrease in the facing space is alleviated when the fuel injection valve is closed. As a result, valve closing response is improved.

Accordingly, even if an energizing period for supplying drive current to a coil is shortened, the fuel of an injection quantity corresponding to the energizing period can be injected. Thus, a dynamic range, in which the injection quantity can be controlled with high accuracy in accordance with the energizing period of the coil, can be increased.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS (First Embodiment)

Figure 1:
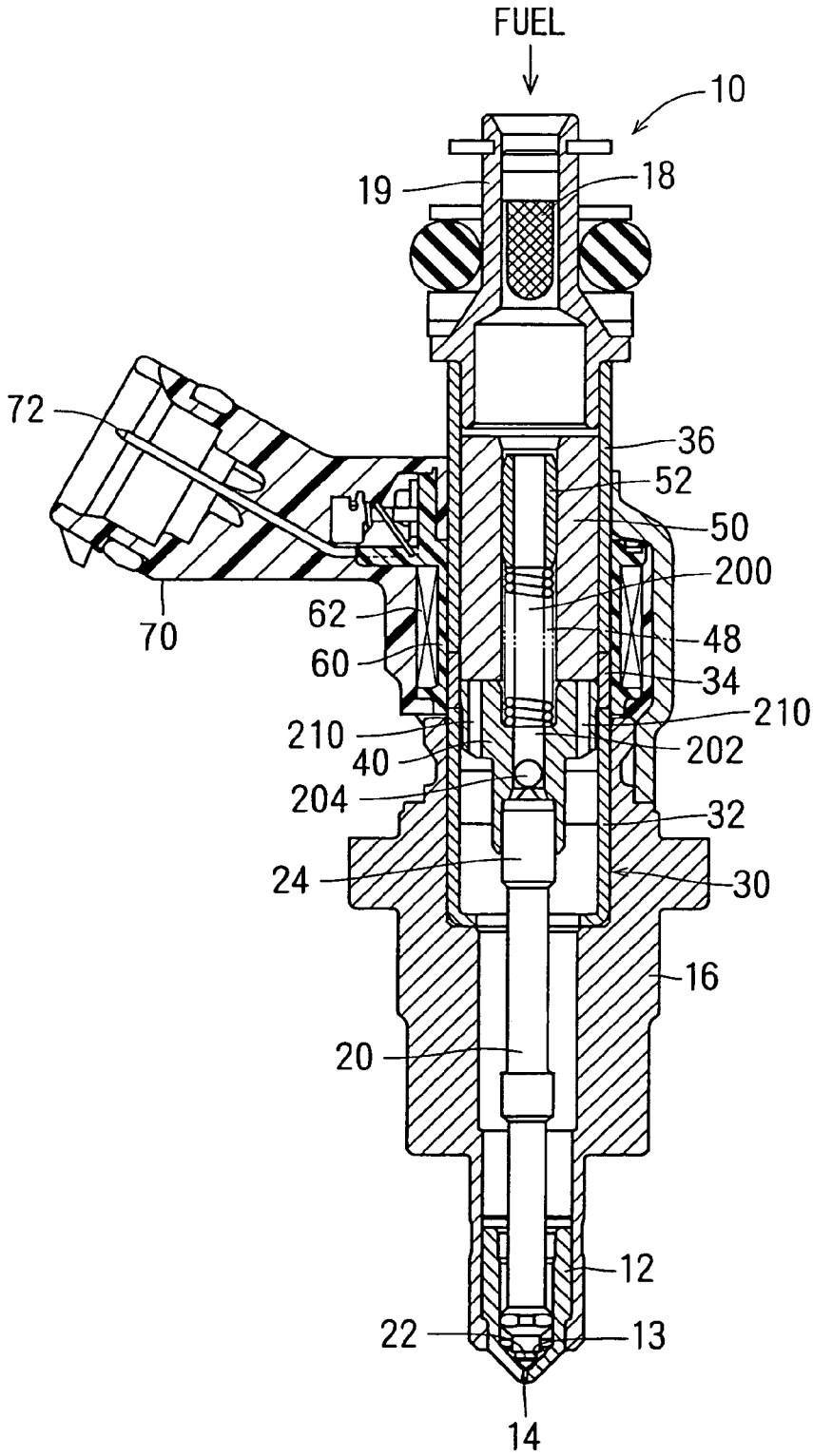
FIG. 1 is a longitudinal cross-sectional view showing a fuel injection valve according to a first embodiment of the present invention.

Referring to FIG. 1, a fuel injection valve 10 according to a first embodiment of the present invention is illustrated. The fuel injection valve 10 of the present embodiment is used as a direct injection type fuel injection valve of a gasoline engine.

A valve body 12 of the fuel injection valve 10 is fixed to a fuel injection side end inner wall surface of a valve housing 16 through, e.g., a welding process. A valve seat 13 is formed on an inner peripheral wall of the valve body 12 on an injection hole 14 side with respect to a fuel flow direction.

A filter 18 is accommodated in a fuel inflow member 19 and set upstream of a fixed core 50 with respect to the fuel flow direction. The filter 18 eliminates extraneous matters included in the fuel supplied to the fuel injection valve 10. The fuel inflow member 19 is fixed to a second magnetic portion 36 of a cylindrical member 30 through, e.g., a welding process.

The fuel flowing into a fuel passage 200 in the fixed core 50 through a fuel inlet of the fuel inflow member 19 and the filter 18 passes through a fuel passage 202 in a movable core 40, an outflow hole 204, and a space between the inner peripheral wall of the valve housing 16 and an outer peripheral wall of a nozzle needle 20, in that order.

The nozzle needle 20 includes the contact portion 22, which can be seated on the valve seat 13, at an end thereof on the injection hole 14 side. The valve seat 13 and the nozzle needle 20 provide a valve portion for performing and interrupting the fuel injection. If the nozzle needle 20 as a valve member separates from the valve seat 13, the fuel passes through an opening passage formed between a contact portion 22 and the valve seat 13 and is injected through the injection hole 14. The fuel injection from the injection hole 14 is interrupted if the contact portion 22 is seated on the valve seat 13.

The cylindrical member 30 is fitted onto the inner peripheral wall of the valve housing 16 on a side opposite from the valve seat 13. The cylindrical member 30 is fixed to the valve housing 16 through, e.g., a welding process. The cylindrical member 30 is comprised of a first magnetic portion 32, a non-magnetic portion 34 as a magnetic resistance portion, and the second magnetic portion 36 in that order from the injection hole 14 side. The non-magnetic portion 34 prevents a magnetic short circuit between the first magnetic portion 32 and the second magnetic portion 36.

The movable core 40 is fixed to an end portion 24 of the nozzle needle 20 on a side opposite from the injection hole 14. The movable core 40 reciprocates together with the nozzle needle 20. The movable core 40 is formed by a magnetic material in the shape of a cylinder. The fuel passage 202 is formed in the center of the movable core 40. The outflow hole 204 is formed in the movable core 40 so that the outflow hole 204 penetrates the cylinder wall of the movable core 40. The outflow hole 204 connects the fuel passage 202 with an outside of the movable core 40.

Figure 2A:
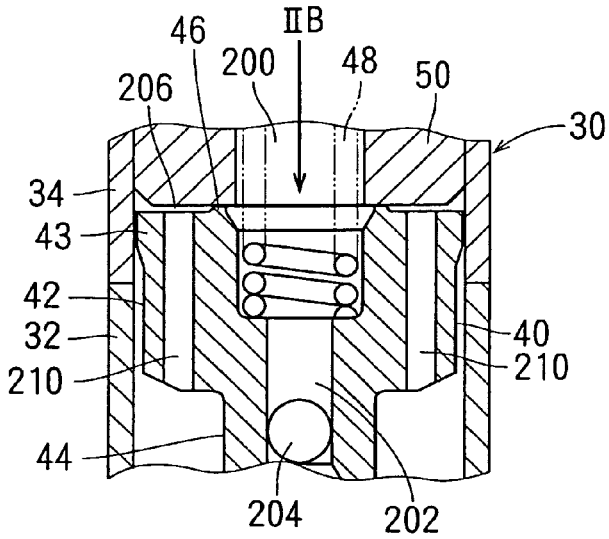
FIG. 2A is a longitudinal cross-sectional view showing a vicinity of a fixed core and a movable core of the fuel injection valve according to the first embodiment.
Figure 2B:
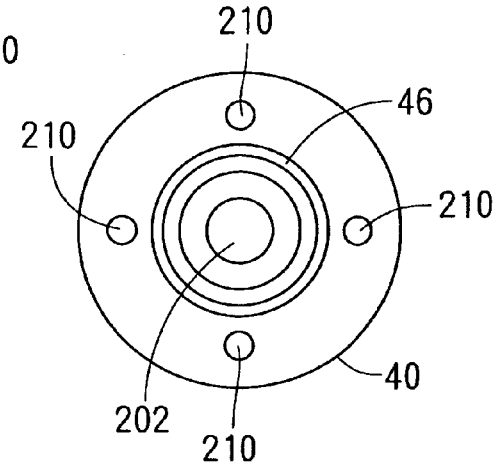
FIG. 2B is a view showing the movable core of FIG. 2A along an arrow mark IIB.

As shown in FIG. 2A, the movable core 40 includes a large diameter portion 42 and a small diameter portion 44 in that order from the fixed core 50 side. The large diameter portion 42 has a guide portion 43, which is guided by the cylindrical member 30 so that the guide portion 43 can reciprocate. In this example embodiment of the invention, at least one communication passage 210 is formed radially outside the fuel passage 202 so that the communication passage(s) 210 axially penetrate the large diameter portion 42 along the reciprocating direction of the movable core 40. In the embodiment illustrated in FIG. 2B, communication passages 210 are formed at four positions at equal intervals of 90° with respect to a circumferential direction. The communication passages 210 connect a facing space 206 provided between the movable core 40 and the fixed core 50 with a space radially outside the small diameter portion 44.

An annular protrusion 46 is formed on a surface of the movable core 40 facing the fixed core 50 through the facing space 206, between the fuel passage 202 and the communication passages 210. The protrusion 46 protrudes toward the fixed core 50. The protrusion 46 is formed radially outside the fuel passage 202 and inside the communication passages 210.

The fixed core 50 shown in FIG. 1 is formed by a magnetic material in the shape of a cylinder. The fixed core 50 is inserted into the cylindrical member 30 and is fixed with the cylindrical member 30 through, e.g., a welding process. The fixed core 50 is disposed on a side of the movable core 40 opposite from the injection hole 14 with respect to a reciprocating direction of the nozzle needle 20. Thus, the fixed core 50 faces the movable core 40.

An adjusting pipe 52 is press-fitted into the fixed core 50. The fuel passes through the inside of the adjusting pipe 52. An end of a spring 48 as a biasing member is engaged with the adjusting pipe 52. The other end of the spring 48 is engaged with the movable core 40. By adjusting a press-fitting amount of the adjusting pipe 52, a load of the spring 48 applied to the movable core 40 can be changed. The biasing force of the spring 48 biases the movable core 40 and the nozzle needle 20 toward the valve seat 13 along the reciprocating direction of the nozzle needle 20.

A spool 60 surrounds the outer periphery of the cylindrical member 30. The coil 62 is wound around the outer periphery of the spool 60. A terminal 72 is formed inside a resin housing 70 by an insertion forming process and electrically connected with a coil 62. A fuel injection quantity is controlled by regulating a pulse width of drive current supplied to the coil 62.

Next, operation of the fuel injection valve 10 will be explained.

The fixed core 50 attracts the movable core 40 against the biasing force of the spring 48 if the coil 62 is energized. The nozzle needle 20 lifts together with the movable core 40, and the contact portion 22 separates from the valve seat 13. Thus, the fuel is injected from the injection hole 14.

Figure 3A:
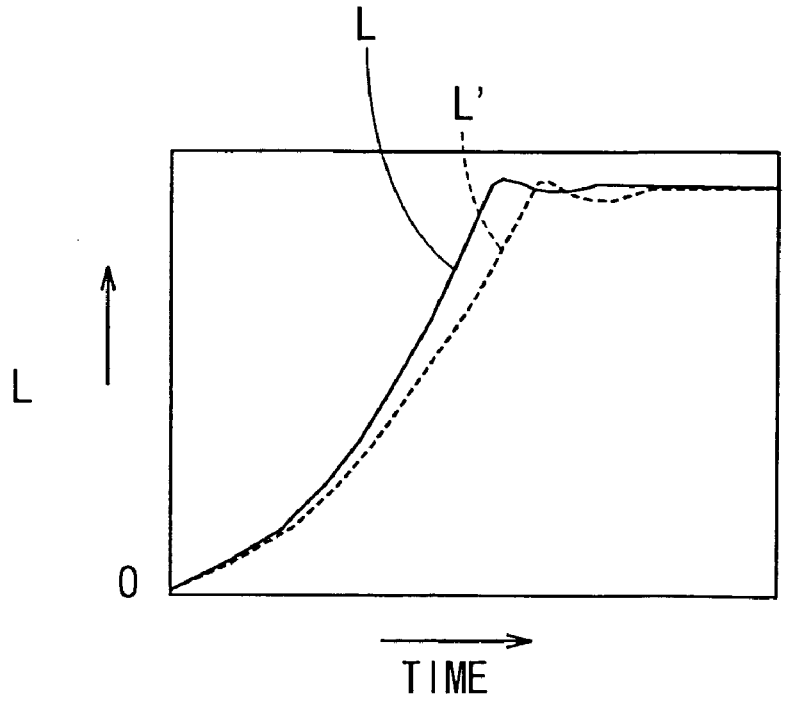
FIG. 3A is a graph showing a lifting amount of a nozzle needle of the fuel injection valve in a valve opening period according to the first embodiment.

The fuel in the facing space 206 positioned radially outside the protrusion 46 flows out to the outer peripheral side of the small diameter portion 44 through the communication passages 210 when the fixed core 50 attracts the movable core 40. Accordingly, a pressure increase in the facing space 206 is inhibited. As a result, as shown by a solid line L in FIG. 3A, the movable core 40 is quickly attracted by the movable core 50, and the nozzle needle 20 quickly separates from the valve seat 13. In FIG. 3A, a sign L represents a lifting amount of the nozzle needle 20. As a result, the valve opening response is improved.

Figure 3B:
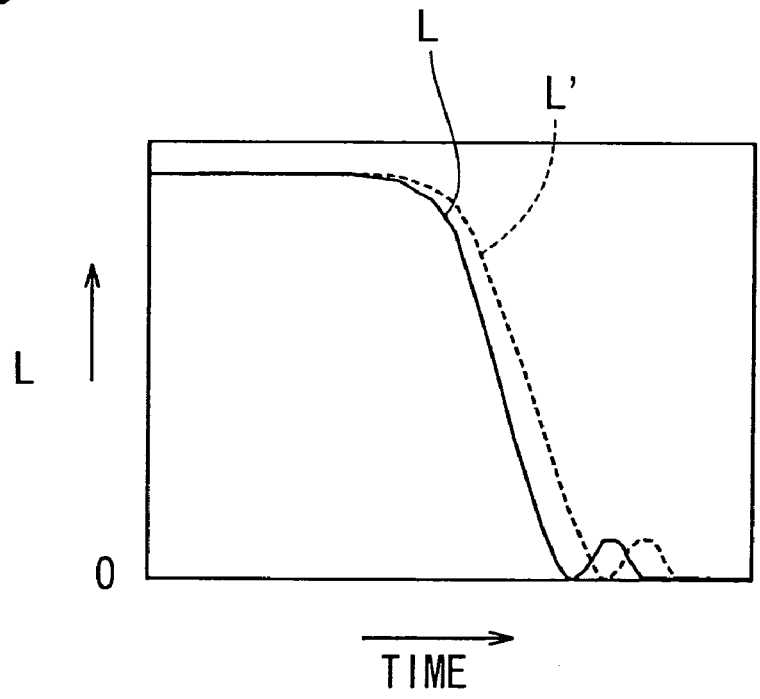
FIG. 3B is a graph showing the lifting amount of the nozzle needle in a valve closing period according to the first embodiment.

The movable core 40 is separated from the fixed core 50 by the biasing force of the spring 48 if the coil 62 is de-energized. At that time, the fuel flows into the facing space 206 from the space radially outside the small diameter portion 44. Accordingly, a pressure decrease in the facing space 206 is inhibited. As a result, as shown by a solid line L in FIG. 3B, the movable core 40 quickly separates from the fixed core 50, and the nozzle needle 20 is quickly seated on the valve seat 13. As a result, the valve closing response is improved.

Figure 8A:
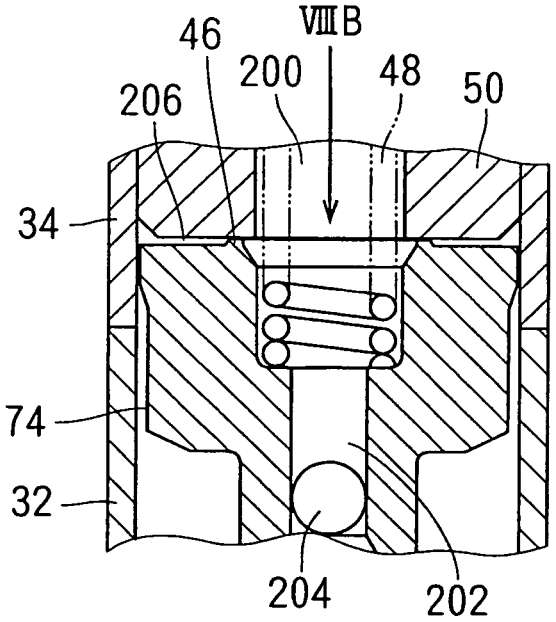
FIG. 8A is a longitudinal cross-sectional view showing a vicinity of a fixed core and a movable core of a fuel injection valve of a related art.
Figure 8B:
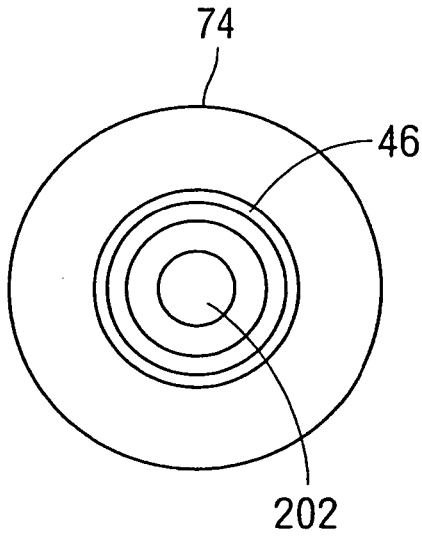
FIG. 8B is a view showing the movable core of FIG. 8A along an arrow mark VIIIB.

In a fuel injection valve of a related art shown in FIGS. 8A and 8B in which no communication passage 210 is formed in a movable core 74, the fuel in the facing space 206 is hindered from flowing out when the valve 10 is opened, and the fuel is hindered from flowing into the facing space 206 when the valve 10 is closed. As a result, as shown by broken lines L' in FIGS. 3A and 3B, the valve opening response and the valve closing response are deteriorated compared to the fuel injection valve 10 of the first embodiment.

In the first embodiment, the communication passage(s) 210 are formed in the movable core 40, which can reciprocate, not in the fixed core 50. Therefore, the fuel can easily flow out of the facing space 206 through the communication passages 210 with the reciprocation of the movable core 40 when the valve 10 opens. Likewise, the fuel can easily flow into the facing space 206 through the communication passages 210 with the reciprocation of the movable core 40 when the valve 10 closes. Thus, the valve opening response and the valve closing response can be improved.

In the first embodiment, the communication passage(s) 210 are formed to penetrate the movable core 40 along the reciprocating direction. Therefore, the resistance of the fuel, which passes through the communication passages 210 when the movable core 40 reciprocates, can be reduced. Thus, the valve opening response and the valve closing response can be improved.

In the first embodiment, the communication passages 210 are disposed between an inner peripheral surface and an outer peripheral surface of the movable core 40 so that the communication passages 210 penetrate the large diameter portion 42 in the axial direction. Therefore, the communication passages 210 can be manufactured easily. In addition, when the communication passages 210 are manufactured, burrs are not produced on a sliding portion of the movable core 40, which slides on the cylindrical portion 30. Therefore, the burrs produced when the communication passages 210 are manufactured do not hinder the reciprocation of the movable core 40.

(Second Embodiment)

Figure 4A:
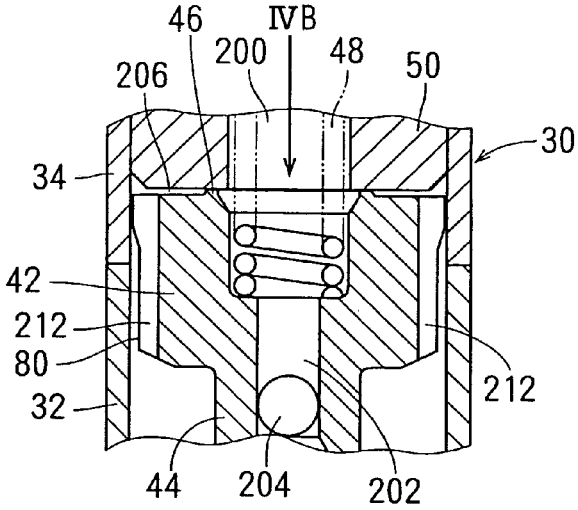
FIG. 4A is a longitudinal cross-sectional view showing a vicinity of a fixed core and a movable core of a fuel injection valve according to a second embodiment of the present invention.
Figure 4B:
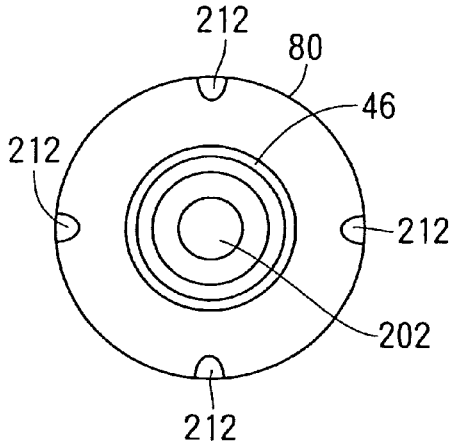
FIG. 4B is a view showing the movable core of FIG. 4A along an arrow mark IVB.

Next, a fuel injection valve 10 according to a second embodiment of the present invention will be explained based on FIGS. 4A and 4B.

In this example embodiment of the invention, at least one communication passage 212 is formed on an outer peripheral surface of a large diameter portion 42 of a movable core 80 so that the communication passage 212 extends along an axial direction. In the embodiment illustrated in FIGS. 4A and 4B, communication passages 212 are formed at four positions, at equal intervals of 90° with respect to a circumferential direction.

(Third Embodiment)

Figure 5A:
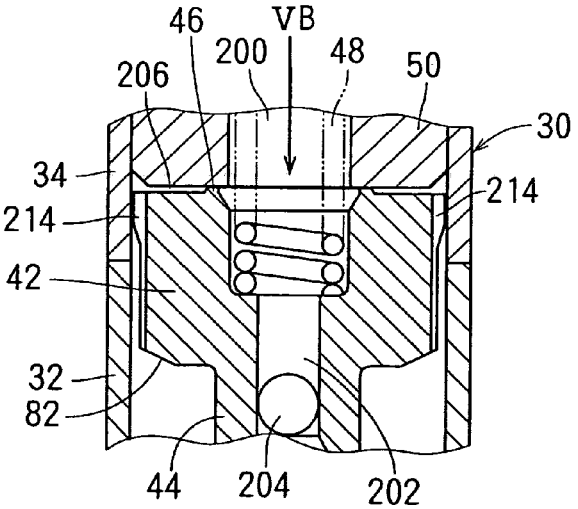
FIG. 5A is a longitudinal cross-sectional view showing a vicinity of a fixed core and a movable core of a fuel injection valve according to a third embodiment of the present invention.
Figure 5B:
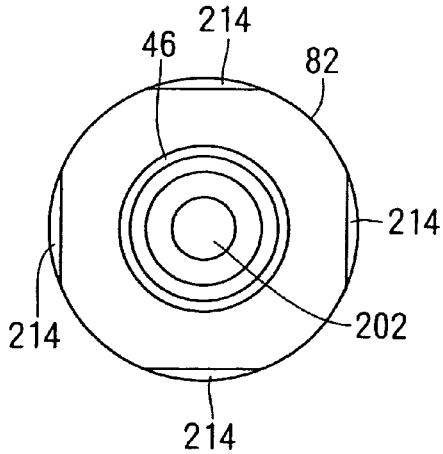
FIG. 5B is a view showing the movable core of FIG. 5A along an arrow mark VB.

Next, a fuel injection valve 10 according to a third embodiment of the present invention will be explained based on FIGS. 5A and 5B.

In this example embodiment of the invention, at least one communication passage 214 is formed by axially chamfering an outer peripheral wall of a large diameter portion 42 of a movable core 82. In the embodiment illustrated in FIGS. 5A and 5B, communication passages 214 are formed at four positions, at equal intervals of 90° with respect to a circumferential direction. The communication passages 214 can be formed easily by a cutting process and the like.

Advantageously, an external angle between the chamfered plane and the outer peripheral surface of the movable core 82 is gentle. Therefore, burrs produced when the communication passages 214 are manufactured can be easily eliminated.

(Fourth Embodiment)

Figure 6A:
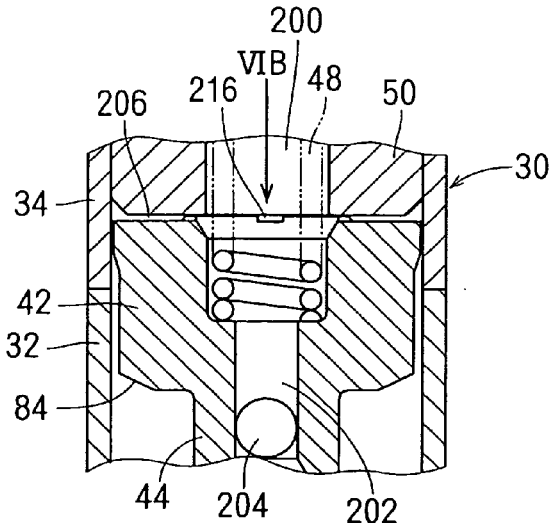
FIG. 6A is a longitudinal cross-sectional view showing a vicinity of a fixed core and a movable core of a fuel injection valve according to a fourth embodiment of the present invention.
Figure 6B:
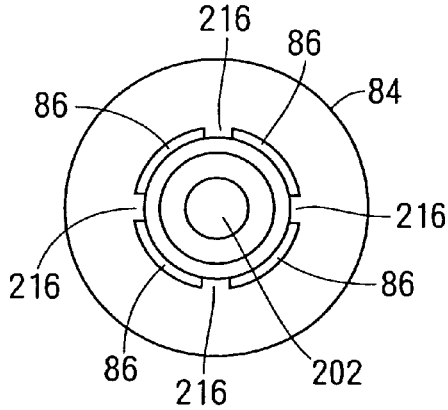
FIG. 6B is a view showing the movable core of FIG. 6A along an arrow mark VIB.

Next, a fuel injection valve 10 according to a fourth embodiment of the present invention will be explained based on FIGS. 6A and 6B.

In this example embodiment of the invention, at least one arc-shaped protrusion 86 is formed around an opening of a fuel passage 202, which is formed in the center of a movable core 84, on a fixed core 50 side. In the embodiment illustrated in FIGS. 6A and 6B, four communication passages 216 are provided among the four protrusions 86 (each communication passage 216 defined between two circumferentially adjacent protrusions 86) at equal intervals of 90° with respect to a circumferential direction. The fuel flows from the facing space 206 to the fuel passage 202 through the communication passages 216 when the valve 10 is opened. The fuel flows from the fuel passage 202 into the facing space 206 when the valve 10 is closed.

(Fifth Embodiment)

Figure 7A:
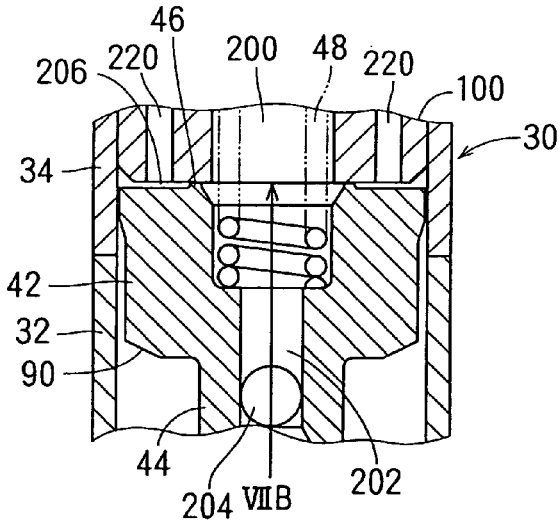
FIG. 7A is a longitudinal cross-sectional view showing a vicinity of a fixed core and a movable core of a fuel injection valve according to a fifth embodiment of the present invention.
Figure 7B:
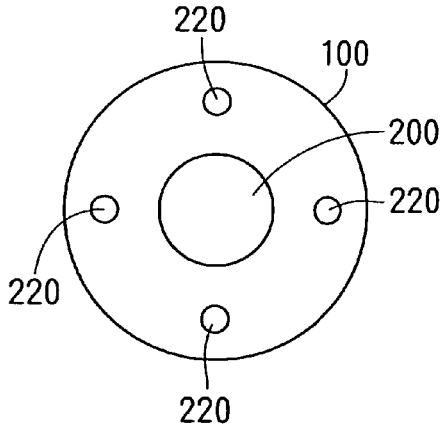
FIG. 7B is a view showing the movable core of FIG. 7A along an arrow mark VIIB.

Next, a fuel injection valve 10 according to a fifth embodiment of the present invention will be explained based on FIGS. 7A and 7B.

In the fifth embodiment, at least one communication passage 220 is formed in a fixed core 100 rather than in a movable core 90. The communication passage(s) 220 open into the facing space 206 radially outside a protrusion 46 formed on the movable core 90. The communication passage (s) 220 may penetrate the fixed core 100 in the axial direction. Alternatively, the communication passage(s) 220 may be bent into radial directions of the fixed core 100 at a certain point with respect to the axial direction and may open in an inner peripheral surface or an outer peripheral surface of the fixed core 100. The fuel flows from the facing space 206 to another space through the communication passage(s) 220 when the valve 10 is opened. The fuel flows from the other space into the facing space 206 when the valve 10 is closed.

In the above embodiments, the valve opening response and the valve closing response are improved. Accordingly, a waveform of a periodical change of the lifting amount of the nozzle needle 20, or a characteristic waveform of a fuel injection ratio, approaches to a pulse waveform of the drive current supplied to the coil 62. Therefore, the fuel injection quantity can be controlled with high accuracy in accordance with the energizing period even if the pulse width of the drive current is narrowed and the energizing period is shortened. As a result, a dynamic range of the fuel injection valve 10 can be increased.

(Modifications)

In the above embodiments, the protrusion protruding toward the fixed core is formed on the surface of the movable core facing the facing space 206 and the fixed core. Alternatively, a protrusion may be formed on a surface of the fixed core facing the facing space and the movable core. Alternatively, protrusions may be formed on both the movable core and the fixed core so that the protrusions can contact each other. Alternatively, no protrusion may be provided on the movable core and the fixed core.

In the above embodiments, the present invention is applied to the direct injection fuel injection valve of the gasoline engine. Alternatively, the present invention may be applied to a fuel injection valve injecting the fuel in an intake pipe.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A fuel injection valve comprising:

a valve member for opening and closing an injection hole;

a movable core disposed to reciprocate with the valve member in an axial direction;

a fixed core disposed on a side of the movable core opposite from the injection hole so that the fixed core faces the movable core; and a coil for generating a magnetic force for attracting the movable core toward the fixed core when energized, wherein the fuel injection valve is formed with a communication passage in at least one of the fixed core and the movable core in addition to a fuel passage, which passes fuel to be injected through the injection hole, the communication passage connecting a facing space, which is provided between the fixed core and the movable core, with another space remote from said facing space.

2. The fuel injection valve as in claim 1, wherein the communication passage is defined to extend in an axial direction, parallel to the reciprocating direction of the movable core.

3. The fuel injection valve as in claim 1, wherein the communication passage is formed to penetrate at least one of the fixed core and the movable core along a reciprocating direction of the movable core.

4. The fuel injection valve as in claim 1, wherein the communication passage is disposed between an inner peripheral surface and an outer peripheral surface of the fixed core or the movable core.

5. The fuel injection valve as in claim 1, wherein the communication passage is formed radially outside the fuel passage.

6. The fuel injection valve as in claim 5, wherein the communication passage is radially inside an outer periphery of the fixed core or the movable core.

7. The fuel injection valve as in claim 5, further comprising:

a protrusion formed on a surface of one of the fixed core and the movable core facing the facing space, between the fuel passage and the communication passage, so that the protrusion protrudes toward the other one of the fixed core and the movable core, and wherein the protrusion contacts the other one when the fuel injection valve is opened.

8. The fuel injection valve as in claim 7, wherein the communication passage is formed in the protrusion so as to communicate the facing space radially outside the protrusion with the fuel passage.

9. The fuel injection valve as in claim 1, wherein the communication passage is formed on an outer peripheral surface of the movable core.

10. The fuel injection valve as in claim 9, wherein the communication passage is formed by chamfering the outer peripheral surface of the movable core.

11. The fuel injection valve as in claim 1, wherein a plurality of communication passages are formed in at least one of the fixed core and the movable core.

12. The fuel injection valve as in claim 11, wherein the communication passages are equi-angularly disposed in a circumferential direction.

13. A fuel injection valve comprising:

a valve member for opening and closing an injection hole;

a movable core disposed to reciprocate with the valve member in an axial direction;

a fixed core disposed on a side of the movable core opposite from the injection hole so that the fixed core faces the movable core; and a coil for generating a magnetic force for attracting the movable core toward the fixed core when energized, wherein a communication passage is defined in at least one of the fixed core and the movable core in addition to a fuel passage, which passes fuel to be injected through the injection hole, whereby the fuel flows into a facing space, which is provided between the fixed core and the movable core, through the communication passage when the movable core separates from the fixed core and flows out of the facing space through the communication passage when the movable core approaches the fixed core.

14. The fuel injection valve as in claim 13, wherein the communication passage is defined to extend in an axial direction, parallel to the reciprocating direction of the movable core.

15. The fuel injection valve as in claim 13, wherein the communication passage is formed to penetrate at least one of the fixed core and the movable core along a reciprocating direction of the movable core.

16. The fuel injection valve as in claim 13, wherein the communication passage is disposed between an inner peripheral surface and an outer peripheral surface of the fixed core or the movable core.

17. The fuel injection valve as in claim 13, wherein the communication passage is formed radially outside the fuel passage.

18. The fuel injection valve as in claim 17, further comprising:

a protrusion formed on a surface of one of the fixed core and the movable core facing the facing space, between the fuel passage and the communication passage, so that the protrusion protrudes toward the other one of the fixed core and the movable core, and wherein the protrusion contacts the other one when the fuel injection valve is opened.

19. The fuel injection valve as in claim 18, wherein the communication passage is formed in the protrusion so as to communicate the facing space radially outside the protrusion with the fuel passage.

20. The fuel injection valve as in claim 13, wherein the communication passage is formed on an outer peripheral surface of the movable core.

21. The fuel injection valve as in claim 13, wherein a plurality of communication passages are formed in at least one of the fixed core and the movable core.

22. The fuel injection valve as in claim 21, wherein the communication passages are equi-angularly disposed in a circumferential direction.

* * * * *